United States Patent [19]

Kriger

[11] 4,135,525

[45] Jan. 23, 1979

[54] MULTIPLE HAIR ROLLERS

[76] Inventor: Igor Kriger, 6812 N. Lakewood, Apt. 3C, Chicago, Ill. 60626

[21] Appl. No.: 847,229

[22] Filed: Oct. 31, 1977

[51] Int. Cl.[2] ..... A45D 2/02

[52] U.S. Cl. ..... 132/39

[58] Field of Search ..... 132/39, 40, 42, 33

[56] References Cited

U.S. PATENT DOCUMENTS

| | | | |
|---|---|---|---|
| 3,224,454 | 12/1965 | Quinio et al. | 132/33 |
| 3,498,300 | 3/1970 | Lehn | 132/40 |
| 3,616,804 | 11/1971 | Simoneaux | 132/40 |
| 3,692,034 | 9/1972 | Stone | 132/40 |

*Primary Examiner*—G.E. McNeill

*Attorney, Agent, or Firm*—Hill, Gross, Simpson, Van Santen, Steadman, Chiara & Simpson

[57] ABSTRACT

A plurality of telescopically associated hair rollers each have an open first end, a second end with openings therein and an outer perforate wall for supporting a flow of drying air therethrough. The rollers are telescopically associated in a nested arrangement with adjacent rollers engageable at the second ends so as to prevent relative rotation therebetween and promote mutual rotation. Each roller which encloses another roller has an elongate slot extending from its open end toward the other end for receiving hair therethrough as the roller is axially moved into position about the next inner roller.

13 Claims, 4 Drawing Figures

MULTIPLE HAIR ROLLERS

BACKGROUND OF THE INVENTION

1. Field of the Invention

This invention relates to hair rollers and is particularly concerned with multiple, releasably engageable hair rollers.

2. Description of the Prior Art

The art recognizes numerous types of roller apparatus upon which a tress of hair is rolled from the distal end toward the root end in hair setting and permanent hair dressing operations. Each of these rollers are basically cylindrical and are provided with either separate or integral apparatus for fastening a rolled tress to the roller and/or to the rolled up position. These fastening devices comprise pins, including hairpins, brush structures, and the inherent magnetism of certain plastics.

Each of these rollers are separate entities and are used individually for rolling a tress of hair upwardly to a desired position.

Rollers of the type mentioned above come in various lengths and diameters, the use of which is selected in dependence upon the size and tightness of the desired wave or curl.

Many of the rollers, particularly the simple tubular plastic rollers have perforate walls or air passages of some type therethrough to promote the flow of drying air.

SUMMARY OF THE INVENTION

An object of the invention is to provide hair roller apparatus by which the drying process is shortened.

Another object of the invention is to provide hair roller apparatus by which the hair is protected against overdrying and overheating.

Another object of the invention is to provide hair roller apparatus by which there is an improvement in set quality and set duration, and also in permanent quality and in permanent duration. The above objects are advantageously achieved by the provision of a plurality of rollers which are releasably engaged in a telescopic, nested relationship, and in which each of the rollers has a separate portion of the same tress of hair wound thereabout.

Each of the rollers has an outer wall which is perforate or in the form of a mesh, an open end, openings at the opposite end, and similarly dimensioned interengagement structures at the opposite end by which the rollers of various diameter may be used in different combinations mutually rotatable with each other and restrained from relative movement with respect to each other.

BRIEF DESCRIPTION OF THE DRAWING

Other objects, features and advantages of the invention, its organization, construction and operation will be best understood from the following detailed description taken in conjunction with the accompanying drawing, on which.

DESCRIPTION OF THE PREFERRED EMBODIMENTS

Figure 1:
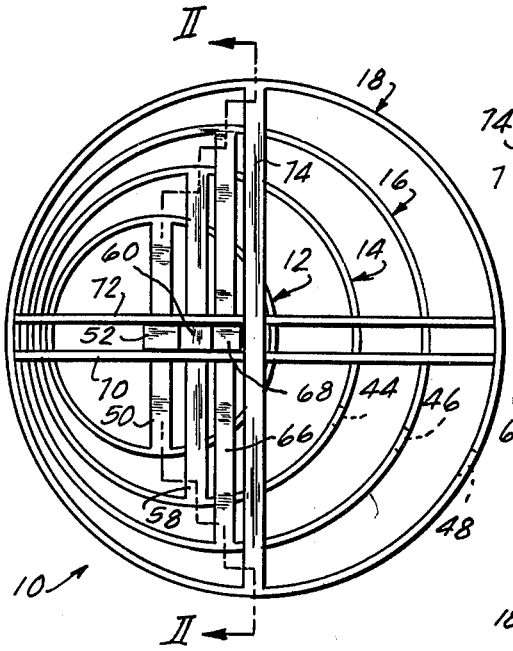
FIG. 1 is an end view of four interengaged rollers constructed in accordance with the principles of the invention.
Figure 2:
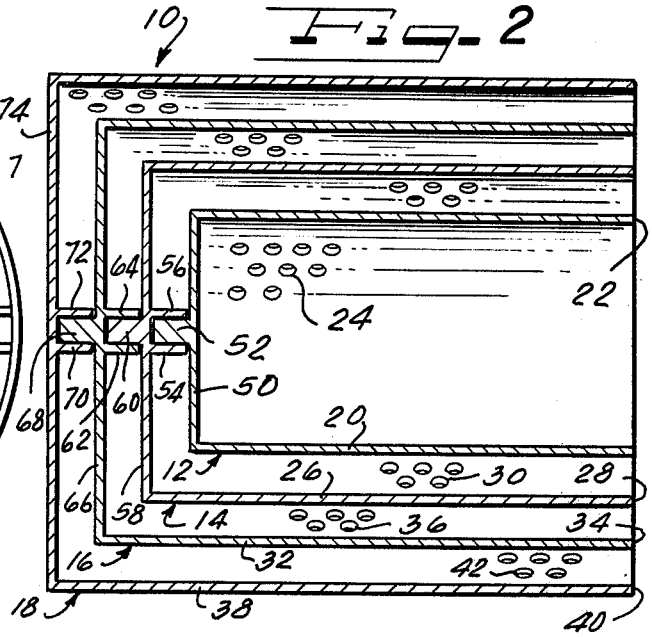
FIG. 2 is a longitudinal sectional view of the apparatus of FIG. 1 taken generally along the parting line II—II of FIG. 1.
Figure 3:
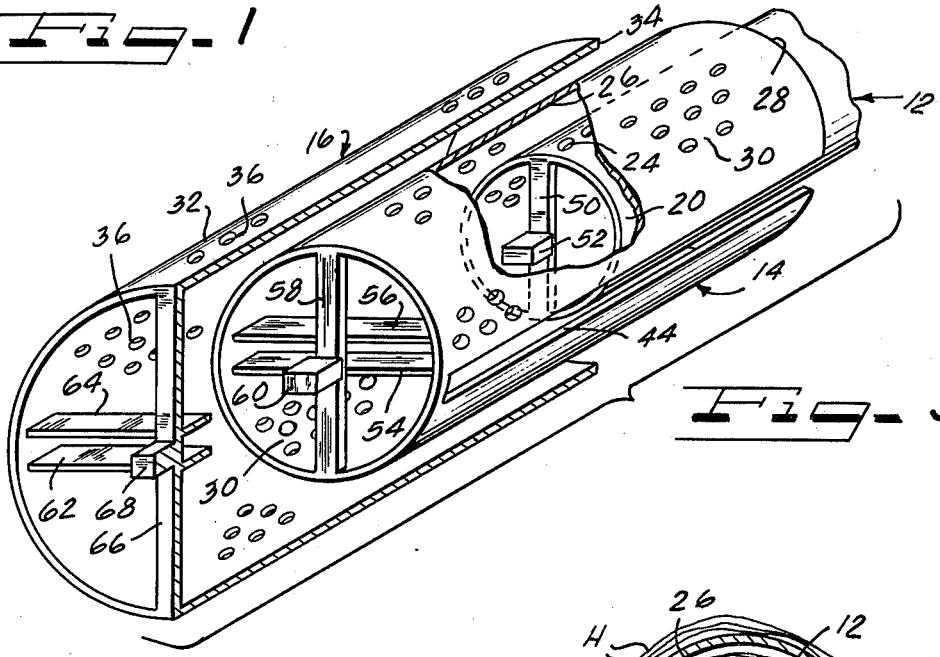
FIG. 3 is a partially exploded view of three of the rollers of FIGS. 1 and 2 shown in a partially telescoped arrangement prior to engagement therebetween.

Referring to FIGS. 1–3, multiple roller apparatus according to the present invention is illustrated at 10 as comprising a plurality of rollers 12, 14, 16 and 18.

The roller 12 comprises an outer wall 20 which has an open end 22. The outer wall 20 is perforate, as at 24, to support a flow of drying air therethrough.

The roller 14 also has an outer wall 26 and an open end 28. The outer wall 26 is also perforate, as illustrated at 30 to support a flow of drying air therethrough.

The roller 16 has an outer wall 32 with an open end 34. The outer wall 32 has openings therethrough to support a flow of drying air, as indicated at 36.

The roller 18 is similarly constructed with an outer wall 38 which has an open end 40, the wall 38 also being perforate, as at 42, to support a flow of drying air therethrough.

Each of the rollers 12–18 also has openings in the ends opposite the open ends 22, 28, 34 and 40. This end of each roller is basically open, as best seen in FIGS. 1 and 3, and supports the coupling structure by which the rollers are engaged for mutual rotation and for restraint against relative rotation. The roller 12, for example, includes a first member 50 which extends diametrically thereacross and which supports a noncircular projection, here a rectangular projection 52, which is axially received in a recess or groove formed by a pair of cross members 54 and 56 which are supported by the roller 14. In the same manner, the roller 14 has a cross member 58 which carries a projection 60 which is received between two spaced parallel members 62 and 64 carried at the respective end of the roller 16. In a similar manner, the roller 16 includes a diametrically disposed member 66 having a projection 68 which is received between a pair of members 70 and 72 of the roller 18. The roller 18, being the outermost roller, may also have additional rigidity provided by a cross member 74, but being the outermost roller, it is not necessary to provide the roller with a projection, as it is not necessary to provide the innermost roller 12 with a pair of members similar to the space members 54, 56.

Inasmuch as the projections are non-circularly shaped, and as they are received in correspondingly shaped recesses, the rollers are engaged for mutual rotation, but are restrained from relative rotation.

Figure 4:
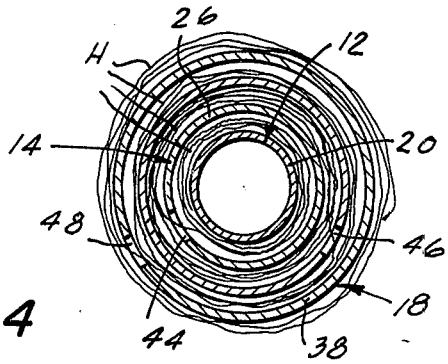
FIG. 4 is a sectional view, diagrammatically illustrated, of four rollers with a tress of hair rolled thereon.

In use, and as best seen from FIGS. 3 and 4, a tress of hair H is wound from the distal end thereof, as desired, about the inner roller 12. The roller 14 is then slid over the roller 12 and includes a longitudinally extending slot 44 for receiving the tress of hair H therein as the roller 14 is moved telescopically to a position in which the projection 52 is engaged between the members 54 and 56. The roller 14 is then rotated, carrying the roller 12 therewith in mutual rotation, to wind a portion of the tress of hair H thereabout. The roller 16 is then telescoped over the roller 12 and 14, a slot 46 receiving an unrolled portion of the tress of hair H, and the projection 60 engaging between the members 62 and 64.

The process of rolling and telescoping on an outer roller may continue as desired, or as is practical with respect to the length of the tress of hair. With the hair rolled in the manner just described, it is readily apparent that the hair is not densely wound upon itself as in previous rollers and that a great amount of air flow for drying has been provided by way of the ends of the rollers, the spacing of the rollers, the less density of the hair and the perforate outer walls of the rollers. The outer walls could also be structured with slots instead of holes, or with a mesh or grill-work structure, the structure shown being for purpose of illustration only.

It is also not necessary that the rollers be used in the specific associations illustrated on the drawing. Inasmuch as the coupling structure is substantially identical, the following combinations are exemplary for the four rollers illustrated herein:

12 and 14;
12 and 16;
12 and 18;
14 and 16;
14 and 18;
16 and 18;
12 and 14 and 16;
14 and 16 and 18; and
12 and 14 and 16 and 18.

As illustrated in FIG. 4, and as opposed to the illustration in FIG. 1, the slots 44, 46 and 48 may be at various circumferential positions about the rollers and are not necessarily aligned with each other, although alignment thereof may be desired. In FIG. 4, the slots are not aligned in an attempt to more clearly illustrate the path of hair about the rollers and through the slots. It should also be pointed out that it is not necessary to roll the hair about each roller in the same direction; for styling effects, it may be desirable to roll the hair in a first direction and then in a second direction.

Although I have described my invention by reference to particular illustrative embodiments thereof, many changes and modifications of the invention may become apparent to those skilled in the art without departing from the spirit and scope thereof. I therefore intend to include within the patent warranted hereon all such changes and modifications as may reasonably and properly be included within the scope of my contribution to the art.

I claim:

1. Hair dressing apparatus comprising
a plurality of hollow rollers of different diameter for telescopic association and disposition,
each of said rollers including an open first end, a second end with openings therein and a wall with openings therethrough,
each of said rollers which has at least one other roller therein including a slot extending from said first end toward said second end to receive a tress of hair therethrough after a portion of the tress has been rolled upon the adjacent inner roller, and
complementary shaped coupling means at said second ends for coupling said rollers for mutual rotation and holding the same against relative rotation, said coupling means forming an open web across said second ends to permit the passage of air therethrough.

2. The apparatus of claim 1, wherein said coupling means comprises, for adjacent rollers, first means on one of said adjacent rollers and second means on the other of said adjacent rollers which releasably engage each other and prevent relative rotation therebetween.

3. The apparatus of claim 1, wherein said
coupling means comprises, for adjacent rollers,
means defining a non-circularly shaped recess at said second end of one of said adjacent rollers, and
means defining a complementary shaped projection at said second end of the other of said adjacent rollers to be received in said recess.

4. The apparatus of claim 3, wherein
said means defining said recess comprises at least two spaced members extending across said second end of the respective roller, and
said means defining said projection comprises another member extending across said second end of the respective roller.

5. A method of dressing hair comprising the steps of:
rolling a portion of a tress of hair about a first perforate hollow roller from the distal end toward the root end,
telescoping a second perforate hollow roller with a slot therein over the first roller with the slot receiving an unrolled portion of the hair tress and contemporaneously telescopically coupling the rollers within the interior thereof, and
rolling another portion of the hair tress about the second perforate hollow roller.

6. The method of claim 5, wherein the first and second recited rolling steps are performed in the same rotary direction.

7. The method of claim 5, wherein the first and second recited rolling steps are performed in opposite rotary directions.

8. Hair dressing apparatus comprising:
a first tubular member for receiving at least one turn of a tress of hair thereabout, said first tubular member including air passageways for supporting a flow of air therethrough;
a second tubular member for receiving at least a portion of a turn of the hair tress thereabout, said second tubular member having a larger cross-sectional dimension than said first tubular member, said second tubular member including air passageways for supporting a flow of air therethrough and a slot extending longitudinally from one end thereof toward the other end to receive the hair tress therethrough as said second tubular member is moved generally axially to a position about said first tubular member prior to receiving its respective turn of the hair tress; and
coupling means for coupling said first and second tubular members for mutual rotation with said first tubular member within said second tubular member, said coupling means comprising
a shaped portion extending outwardly from the other end of said first tubular member, and
a complementary shaped inwardly facing recess at the other end of said second tubular member for receiving and holding said projection against rotation relative thereto.

9. Hair dressing apparatus comprising:
a first tubular member for receiving at least one turn of a tress of hair thereabout, said first tubular member including air passageways for supporting a flow of air therethrough;
a second tubular member for receiving at least a portion of a turn of the hair tress thereabout, said second tubular member having a larger cross-sectional dimension than said first tubular member, said second tubular member including air passageways for supporting a flow of air therethrough and a slot extending longitudinally from one end thereof toward the other end to receive the hair tress therethrough as said second tubular member is moved generally axially to a position about said first tubular member prior to receiving its respective turn of the hair tress; and coupling means for coupling said first and second tubular members for mutual rotation with said first tubular member within said second tubular member, said coupling means comprising a non-circular projection extending outwardly from said other end of said first tubular member, and means defining an inwardly-opening, non-circular recess at said other end of said second tubular member for receiving said projection therein and holding said first tubular member against relative rotation.

10. The apparatus of claim 9, comprising:

a first cross member extending diametrically across said other end of said first tubular member and carrying said projection, said projection being rectangular; and at least two second cross members extending, spaced apart, generally diametrically across said other end of said second tubular member to receive said rectangular member therebetween.

11. Hair dressing apparatus comprising:

a first tubular member for receiving at least one turn of a tress of hair thereabout, said first tubular member including air passageways for supporting a flow of air therethrough;

a second tubular member for receiving at least a portion of a turn of the hair tress thereabout, said second tubular member having a larger cross-sectional dimension than said first tubular member, said second tubular member including air passageways for supporting a flow of air therethrough and a slot extending longitudinally from one end thereof toward the other end to receive the hair tress therethrough as said second tubular member is moved generally axially to a position about said first tubular member prior to receiving its respective turn of the hair tress; and coupling means for coupling said first and second tubular members for mutual rotation with said first tubular member within said second tubular member, said coupling means comprising first shaped means at said other end of one of said tubular members, and second shaped means, shaped complementary to and engageable with said first shaped means, at said other end of the other of said tubular members.

12. The apparatus of claim 11 wherein:

each of said tubular members comprises an outer wall, said air passageways including openings extending through said outer wall.

13. The apparatus of claim 11, wherein:

each of said tubular members includes an open end at said one end and openings at the other end, and each of said tubular members includes an outer wall having openings therethrough, said openings and open ends constituting said air passageways for supporting a flow of air.

* * * * *